US009410416B2

(12) United States Patent
McKenzie et al.

(10) Patent No.: US 9,410,416 B2
(45) Date of Patent: Aug. 9, 2016

(54) SUBSEA FLOW SPLITTING ARRANGEMENT

(71) Applicant: FMC Kongsberg Subsea AS, Kongsberg (NO)

(72) Inventors: Lachlan McKenzie, Røyken (NO); Steinar Eriksen, Hokksund (NO); Marit Storvik, Oslo (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 14/385,134

(22) PCT Filed: Mar. 11, 2013

(86) PCT No.: PCT/EP2013/054816
§ 371 (c)(1),
(2) Date: Sep. 12, 2014

(87) PCT Pub. No.: WO2013/135600
PCT Pub. Date: Sep. 19, 2013

(65) Prior Publication Data

US 2015/0101820 A1 Apr. 16, 2015

(30) Foreign Application Priority Data

Mar. 14, 2012 (NO) ..... 20120301

(51) Int. Cl.
*E21B 7/12* (2006.01)
*E21B 43/36* (2006.01)

(52) U.S. Cl.
CPC ..... *E21B 43/36* (2013.01)

(58) Field of Classification Search
CPC ..... E21B 43/36
USPC ..... 166/357
See application file for complete search history.

(56) References Cited

U.S. PATENT DOCUMENTS

| | | | | |
|---|---|---|---|---|
| 3,516,490 | A | 6/1970 | Smalling et al. | |
| 3,745,773 | A | 7/1973 | Cunningham | |
| 4,816,146 | A * | 3/1989 | Schertler | B01D 17/0211 210/104 |
| 6,276,455 | B1 * | 8/2001 | Gonzalez | E21B 21/001 166/267 |
| 8,505,363 | B2 * | 8/2013 | Masek | G01N 9/30 73/61.44 |
| 8,657,940 | B2 * | 2/2014 | Aarebrot | B01D 17/0214 55/447 |
| 2009/0321366 | A1 * | 12/2009 | Poorte | F17D 1/005 210/747.5 |
| 2015/0260026 | A1 * | 9/2015 | Whitney | E21B 43/36 166/357 |

FOREIGN PATENT DOCUMENTS

| | | |
|---|---|---|
| WO | WO 82/01387 A1 | 4/1982 |
| WO | WO 83/01471 A1 | 4/1983 |

* cited by examiner

*Primary Examiner* — Matthew R Buck
*Assistant Examiner* — Aaron Lembo

(57) ABSTRACT

A subsea system and an oil/gas outlet arrangement for splitting of oil and gas. The subsea system comprising a separator (1), the separator (1) comprising; at least one well flow inlet (13) for a multiphase flow mixture of at least oil and gas, an oil/gas outlet arrangement (15) arranged in a distance from the well flow inlet (13) over which distance the multiphase flow mixture separates in at least an oil phase (O) and a gas phase (G), the oil/gas outlet arrangement (15) comprising; at least one conical crown device (2), the conical crown device (2) having an outer wall with at least one cutout (4) extending through said outer wall, through which cutouts (4) the oil and gas flow into the crown device (2), each crown device (2) is in fluid connection with at least one fluid outlet (5, 6), and wherein the oil/gas outlet arrangement (15) comprises at least two fluid outlets (5, 6).

9 Claims, 3 Drawing Sheets

SUBSEA FLOW SPLITTING ARRANGEMENT

FIELD OF THE INVENTION

The invention concerns a subsea system comprising a separator with an oil/gas outlet arrangement, e.g. a flow splitter, for splitting a multiphase flow mixture of at least oil and gas in two or more flows having similar flow mixture.

BACKGROUND OF THE INVENTION

It is common to use different kinds of subsea equipment such as separators, pumps, compressors, etc. in different subsea applications. Multiphase well production fluids comprising a mixture of water, oil and gas enter the separator through a fluid inlet and are separated through a number of fluid outlets, i.e. a crown device, such as a gas outlet, a water outlet and/or an oil- or hydrocarbon outlet, in the separator.

It has proved to be a challenge, when having one fluid outlet from the separator, that the pump capacity of the pump driving the multiphase oil- and gas flow from the separator through the crown has to be larger than what is available on the market today. It is therefore a need of a solution that solves this issue about the available maximum pump capacity.

In relation to subsea systems, e.g. from the "Tordis" or "Marlim" field on the Norwegian continental shelf, it is known to use subsea flow splitters, such as "T-pieces" or "Y-pieces", for the splitting of a multiphase oil- and gas flow in one pipeline into two flows in separate pipelines. One reason for splitting the flow may be to have smaller equipment handling parts of the wellstream instead of one large equipment unit handling the whole wellstream. However, by the use of these known flow splitters, the mixture ratio of the oil and gas may be different in the flows separated in the flow splitter, as one is not sure how the flows divide in the flow splitter nor the flow regime of the flow before entering the flow splitter. As this is the case, mixers are often arranged upstream of the flow splitter to create a more uniform flow mixture at the inlet of the flow splitter, thereby ensuring more equal splitting of the flow. This adds to the complexity, size and price of the system. There is therefore a need for a simplified, more reliable way of splitting one flow in two or more equal flows.

An object of the invention is therefore to provide a subsea system that eliminates or reduces at least some of the disadvantages related to the prior art solutions.

SUMMARY OF THE INVENTION

The invention is set forth and characterized in the independent claims, while the dependent claims describe other characteristics of the invention.

The invention concerns a subsea system comprising a separator, the separator comprising;

- at least one well flow inlet for a multiphase flow mixture of at least oil and gas,
- an oil/gas outlet arrangement arranged at a distance from the well flow inlet over which distance the multiphase flow mixture separates into at least an oil phase and a gas phase, the oil/gas outlet arrangement comprising;
- at least one conical crown device, the conical crown device having an outer wall with at least one cutout extending through said outer wall, through which cutouts the oil and gas flow into the crown device,
- each crown device is in fluid connection with at least one fluid outlet, and
- wherein the oil/gas outlet arrangement comprises at least two fluid outlets.

The distance between the well flow inlet and the oil/gas outlet arrangement should be sufficient for the multiphase flow mixture to separate due to gravitational forces into two phases of oil and gas given the circumstance that water has been separated at an earlier step of the separation process. If the multiphase flow mixture that enters the separator contains water, the distance may be sufficient to separate gas, oil and water due to gravitational forces. Then the water can be separated out of the separator through a water outlet in the lower part of the separator. The water outlet may be positioned a sufficient distance for the separation process into the gas phase, oil phase and water phase to take place.

The oil/gas outlet arrangement may comprise a crown device, which is a device for receiving and forwarding a flow mixture. The crown device may be provided with at least one cutout in the upper part. The crown device may have any shape, such as circular, semicircular etc. The at least one cutout extends through the outer wall of the crown device. The upper end of the crown device is preferably open over the whole top area, but in another embodiment only parts may be open. The oil and gas flow into the crown device through the cutouts or through the top area. If there are two or a number of cutouts in the crown device, the cutouts are preferably evenly spaced along the circumference. The cutouts may be substantially of a rectangular shape, or may have any shape such as square, trapezoidal, circular, elliptic, parallelogram, etc.

According to another aspect of the subsea system, the at least one cutout may extend from the top end of the crown device a distance, e.g. downwardly, in the longitudinal direction of the crown device. The area of the cutouts in the crown device preferably ranges into both the oil phase and the gas phase. The oil and gas phase admixes at the cutouts and is guided through the first and second fluid outlets. The lower end of the cutouts are preferably arranged above the water phase. This minimizes the risk of water being produced with the gas/oil production flow through the oil/gas outlet arrangement. The gas and oil phase may enter the crown device through the cutouts or at the upper, fully, or partially, open upper end of the crown device.

In an embodiment of the oil/gas outlet arrangement, there may be arranged at least two crown devices side by side in a direction perpendicular to the axial direction of the separator. In another embodiment the at least two crown devices are arranged perpendicular to the axial direction of the separator. For process reasons, i.e. maximizing water retention time in the separator, it may be desirable to arrange the oil/gas outlet, i.e. the cutouts in the crown device, as high as possible in the separator. If two crown devices are arranged perpendicular to the axial direction of the separator, the maximum height may be limited due to geometric considerations.

In an embodiment of the subsea system, the at least one conical crown device comprises at least one divider element, where each divider element divides the conical crown device volume into two substantially equal sub-volumes, each sub-volume being in fluid connection with at least one fluid outlet. The divider element may separate the first fluid outlet from the second fluid outlet and end in the area defined by a "Y-shape" where the first and second fluid outlets bifurcate into a first pipe and a second pipe, respectively. In other words, the divider element is preferably arranged in an area defined by the upper part of the crown device and a region where the first fluid outlet and the second fluid outlet are split into a separate first pipe and second pipe. The first pipe and second pipe may in one embodiment separate inside the separator. In another embodiment it is also possible that the first pipe and second pipe separate an the outside of the separator. This is of course dependent on the specific demands in each project. A number of divider elements may be arranged in the crown devices, dependent on the number of desired fluid outlets. The divider elements can be arranged at any angle with respect to the axial direction of the separator. The volume of each of the fluid outlets is preferably equal, to ensure that the flow distribution in each of the fluid outlets is substantially equal.

In an embodiment of the subsea system, at least one gas outlet may be arranged in the upper part of the separator in the proximity of the well flow inlet. A gas injection pipe may be arranged at the oil/gas outlet arrangement. The gas separated through the gas outlet may be directed to a gas splitter. The gas splitter is arranged to split the gas flow into two pipes, one gas production pipe and one gas injection pipe. Alternatively, only the gas splitter may guide the gas through only one of said gas injection pipe or gas production pipe. The gas production pipe directs the gas flow to a production facility, while the gas injection pipe directs the gas flow back in to the separator at the crown device, for mixing with the oil phase. The gas production pipe and gas injection pipe may preferably be provided with flow control means, such as a valve, downstream of the gas splitter to control the flow of gas in the gas production pipe and the gas injection pipe. Alternatively there may be no gas outlet, as all the gas is kept in the separator until it leaves the separator through the oil/gas outlet arrangement.

In an embodiment of the subsea system, there might be arranged at least one pump downstream of each fluid outlet.

The invention also concerns an oil/gas outlet arrangement for splitting of oil and gas. The arrangement comprises at least one conical crown device, the conical crown device may have an outer wall and at least one cutout extending through said outer wall, through which cutouts the oil and gas flow into the crown device, each crown device may be in fluid connection with at least one fluid outlet, and wherein the oil/gas outlet arrangement comprises at least two fluid outlets.

The invention will now be described in non-limiting embodiments and with reference to the attached drawings, wherein;

DETAILED DESCRIPTION OF A PREFERENTIAL EMBODIMENT

Figure 1:
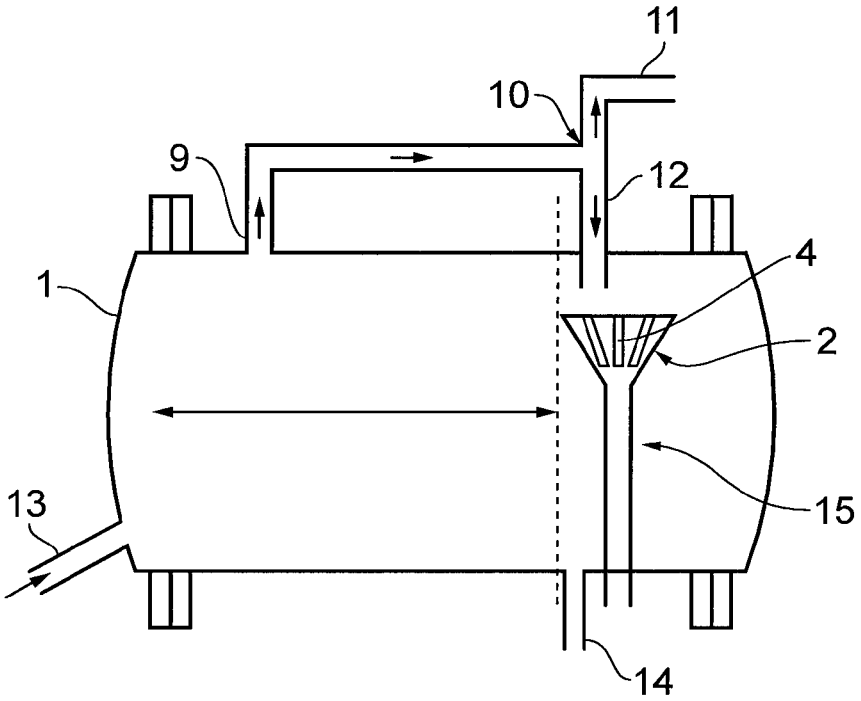
FIG. 1 shows an embodiment of the separator and one oil/gas outlet arrangement according to the invention.

An embodiment of a separator 1 is shown in FIG. 1. The separator 1 is provided with a well flow inlet 13 for receiving the multiphase flow mixture from a well. The multiphase flow mixture enters the separator 1 and separates into two or three phases of water, oil and gas. Dependent on the gas ratio of the multiphase flow mixture, smaller or larger parts of the gas may be separated through gas outlet 9 for production or reinjection at a later stage in the separation process, which will be described later. An oil/gas outlet arrangement 15 is provided at a distance from the well flow net 13 inside the separator 1. The distance between the well flow net 13 and the oil/gas outlet arrangement 15 is sufficient for the multiphase flow mixture to separate due to gravitational forces into two phases of oil and gas given the circumstance that water has been separated at an earlier step of the separation process. If the multiphase flow mixture contains water, the distance is sufficient to separate oil and water with gravitational forces. Then the water is separated out of the separator through a water outlet 14 at the lower part of the separator 1. The water outlet 14 is positioned at a sufficient distance for the separation process into the gas phase, oil phase and water phase to take place.

The oil/gas outlet arrangement 15 comprises at least a crown device 2. A mixture of oil and gas enters the crown device 2 through cutouts 4 for further processing, which will be described in greater detail later.

The gas separated through the gas outlet 9 is directed to a gas splitter 10. The gas splitter 10 divides the gas flow into two pipes, one gas production pipe 11 and one gas injection pipe 12. The gas production pipe 11 directs the gas flow directly to a production facility (not shown), while the gas injection pipe 12 directs the gas flow back in to the separator 1 at the crown device 2 for mixing with the oil phase. The gas production pipe 11 and gas injection pipe 12 are preferably provided with flow control means (not shown) such as a valve, downstream of the gas splitter 10 to control the flow of gas in the gas production pipe 11 and the gas injection pipe 12. Alternatively there may be a configuration without the gas splitter and/or gas production pipe 11. Alternatively there may be no gas outlet 9, as all the gas is kept in the separator until it leaves the separator through the oil/gas outlet arrangement 15.

Figure 2:
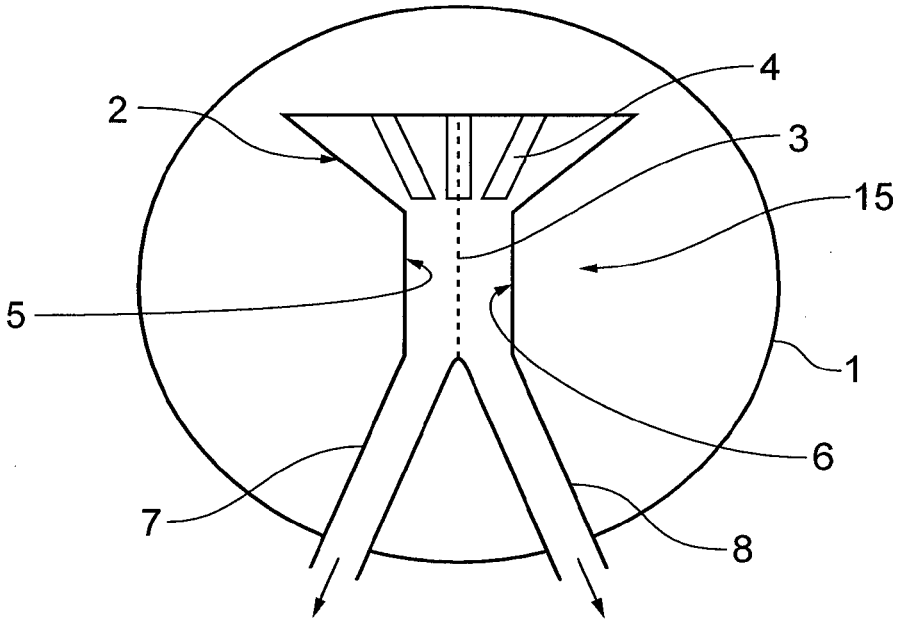
FIG. 2 shows an end view of the oil/gas outlet arrangement arranged in the separator.

FIG. 2 shows an end view of the separator 1 with an oil/gas outlet arrangement 15 as in FIG. 1. The oil/gas outlet arrangement 15 comprises a crown device 2 provided with at least one cutout 4 at the upper part. The crown device 2 may have any shape, such as circular, semicircular etc. The at least one cutout 4 extends through the outer wall of the crown device 2, and the oil and gas flow into the crown device 2 through the cutout 4. Given the circumstance that there are two or a number of cutouts 4, the cutouts 4 are preferably evenly spaced along the circumference of the upper part of the crown device 2. The cutouts 4 are shown having a substantially rectangular shape, but they may have any shape, such as square, trapezoidal, circular, elliptic, parallelogram, etc. A divider element 3 divides the volume of the crown device 2 to define a first 5 and a second 6 fluid outlet. The divider element 3 separates the first fluid outlet 5 from the second fluid outlet 6 and ends in the area defined by a "Y-shape" where the first and second fluid outlets 5, 6 bifurcate into a first pipe 7 and a second pipe 8, respectively. In other words, the divider element 3 is arranged in an area defined by the upper part of the oil/gas outlet arrangement 15 and a region where the first fluid outlet 5 and the second fluid outlet 6 are split into a separate first pipe 7 and second pipe 8. In the embodiment shown in FIG. 2 the first pipe 7 and second pipe 8 separate inside the separator 1. But it is also possible that the first pipe 7 and second pipe 8 separate on the outside of the separator 1. This is of course dependent on the specific demands of each project.

Figure 3:
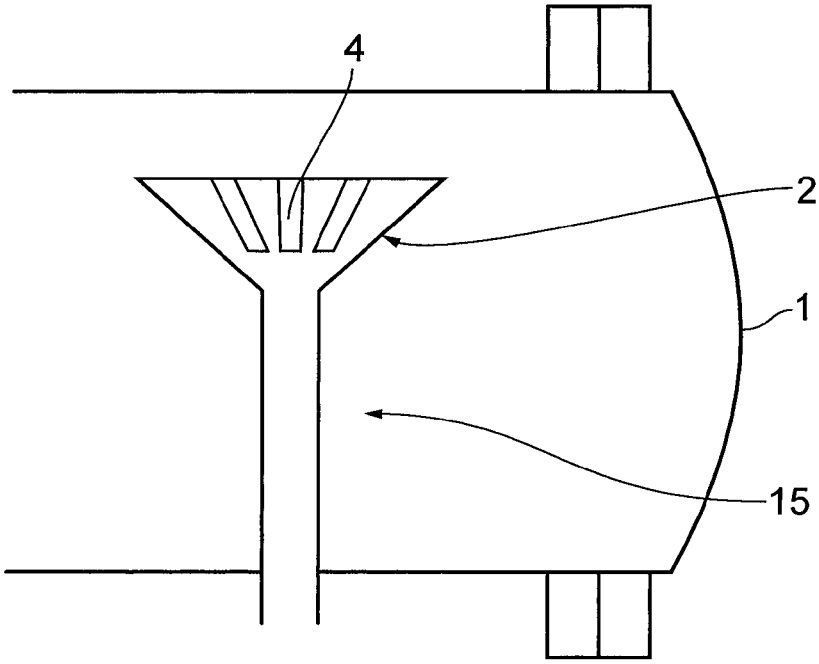
FIG. 3 shows a side view of the oil/gas outlet arrangement arranged in the separator.

FIG. 3 is a side view of the oil/gas outlet arrangement 15 arranged in the separator 1.

Figure 4:
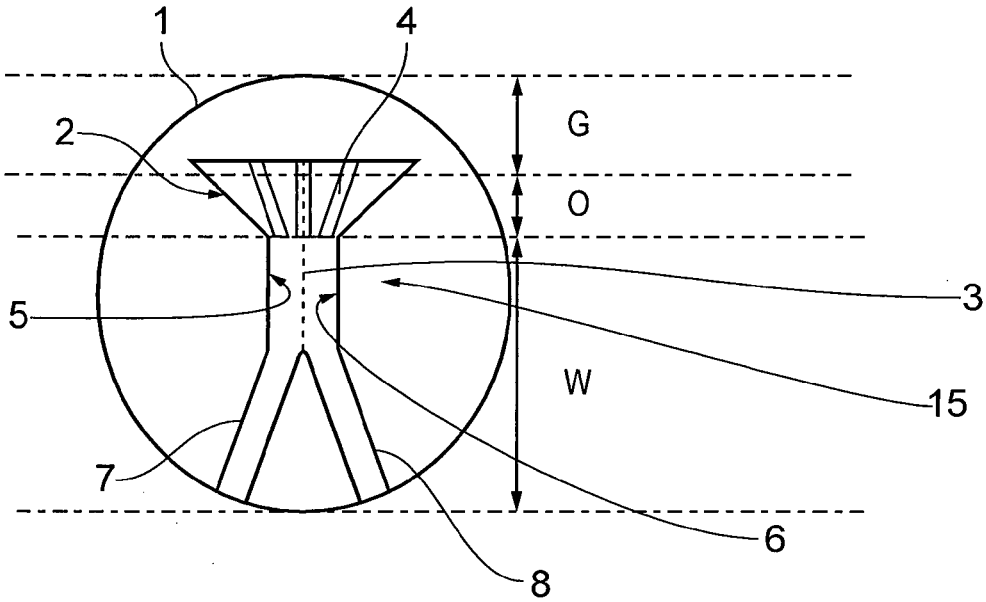
FIG. 4 shows the distribution of water, oil and gas in the separator.

FIG. 4 shows the embodiment of the oil/gas outlet arrangement 15 in FIG. 2, wherein the distribution of the fluid phases is shown. The water phase W is in the lower part of the separator 1, the oil phase O is in the middle part, and the gas phase G is in the upper part of the separator 1 due to the density of the water, oil and gas. The area of the cutouts 4 in the crown device 2 ranges into both the oil phase O and the gas phase G. The oil- and gas phase admixes at the cutouts 4 and is guided through the first and second fluid outlets 5, 6. As is disclosed in the figure, the lower end of the cutouts 4 is arranged above the water phase W in the separator 1. This minimizes the risk of water being produced with gas/oil production flow through the oil/gas outlet arrangement 15.

The arrangement of the divider element 3 as described above and with regards to the description of FIG. 2, ensures that the mixture ratio of oil and gas in the first fluid outlet 5 and second fluid outlet 6 is maintained equal. One or more pumps (not shown) may be arranged in connection with each of the first pipe 7 and the second pipe 8, on the outside of the separator 1.

Additionally, the gas injection pipe 12 (as shown in FIG. 1) may be arranged in the upper part of the crown device 2 for mixing with the oil phase O and gas phase G. The height of the crown device 2 inside the separator 1 is adjustable and is of course dependent on the water cut, i.e. the ratio of water produced compared to the total volume of fluid produced. If one experiences or predicts a high water cut, one may reduce the height of the crown device 2, i.e. the cutouts 4 in the crown.

Figure 5:
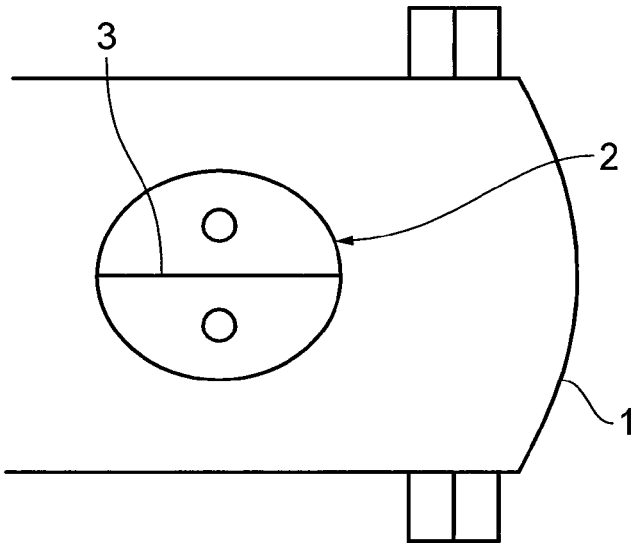
FIG. 5 shows a top view of an oil/gas outlet arrangement arranged in a separator.

FIG. 5 shows a top view of an oil/gas outlet arrangement 15 arranged inside the separator 1. The top of the oil/gas outlet arrangement 15, i.e. the crown device 2, is preferably open over the whole top area, but in another embodiment only parts may be open. A divider element 3 is arranged in the crown device 2 axially parallel to the length of the separator 1. A number of such divider elements 3 may be arranged in the crown devices 2, dependent on the number of desired fluid outlets, which divider elements 3 can be arranged at any angle with respect to the axial direction of the separator 1. The volume of each of the fluid outlets is preferably equal to ensure that the flow distribution in each of the fluid outlets is substantially equal. In the embodiment of FIG. 5, the top of the crown device 2 is shown having a circular shape. In this embodiment the angle between each divider element 3 will preferably be equal, resulting in the volume in each of the fluid outlets being equal.

Figure 6:
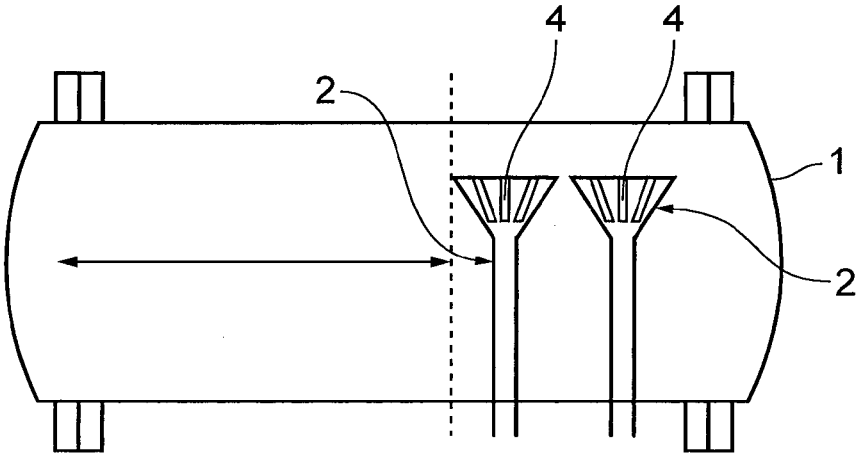
FIG. 6 shows an embodiment of the separator and an oil/gas outlet arrangement comprising two crown device.

Referring to FIG. 6 it is shown an embodiment of two crown devices 2 arranged next to each other in the axial direction of the separator 1. The crown devices 2 may each have none, one or a number of divider elements 3, and one or a number of fluid outlets 5, 6 dependent on the number of divider elements 3. By arranging several crown devices 2 next to each other along the axial length of the separator 1, the separator length will increase.

Figure 7A:
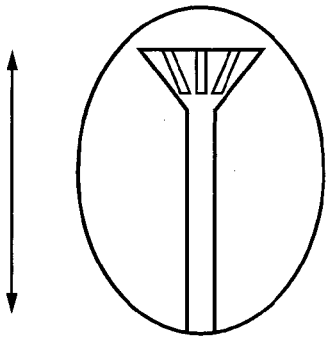
FIG. 7A shows an end view of the maximum possible crown device height when using one crown device.
Figure 7B:
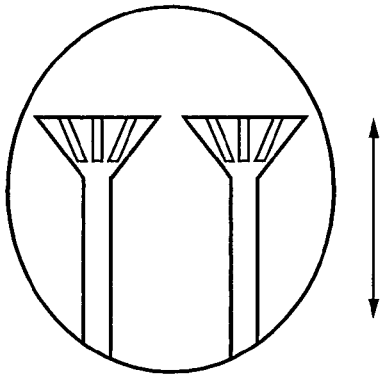
FIG. 7B shows an end view of the maximum possible crown device height when arranging two crown devices transverse in the separator.

FIG. 7A shows the maximum height of one crown device 2 in a separator 1. FIG. 7B shows the maximum heights of two crown devices 2 arranged side by side in a direction perpendicular to the axial direction of the separator 1. The embodiment in FIG. 7A provides a higher maximum height of the crown device 2 than the maximum height of the two crown devices 2 disclosed in FIG. 7B. For process reasons, i.e. maximizing water retention time in the separator, it may be desirable to arrange the oil/gas outlet, i.e. the cutouts 4 of the crown device 2, as high as possible in the separator 1. If two crown devices 2 are to be arranged perpendicular to the axial direction of the separator 1, the maximum height may be limited due to geometric considerations.

The invention is herein described in non-limiting embodiments. A skilled person in the art will understand that alterations and modifications to the embodiments may be made that are within the scope of the invention as defined in the attached claims, and elements or features of the different embodiments may be combined in any configuration.

The invention claimed is:

1. A subsea system comprising a separator for a multiphase flow mixture having at least an oil phase and a gas phase, the separator comprising:

at least one well flow inlet for the multiphase flow mixture;

an oil/gas outlet arrangement which is spaced laterally from the well flow inlet, the oil/gas outlet arrangement comprising:

at least one crown device having an inverted conical configuration and an axis which is oriented generally vertically, each crown device including an outer wall and at least one cutout formed in the outer wall through which the oil and gas can flow into the crown device, the cutout extending longitudinally from a top end of the crown device toward a bottom end of the crown device;

wherein the bottom end of each crown device is connected to at least two fluid outlets in the oil/gas outlet arrangement.

2. A subsea system according to claim 1, wherein the at least one conical crown device comprises at least one divider element which divides a volume of the conical crown device into two substantially equal sub-volumes, each sub-volume being in fluid connection with a respective fluid outlet.

3. A subsea system according to claim 1, wherein the at least one crown device comprises at least two cutouts arranged evenly around the circumference of the crown device.

4. A subsea system according to claim 1, wherein the at least two fluid outlets are connected to respective pipes located on the inside of the separator.

5. A subsea system according to claim 1, wherein the at least two fluid outlets are connected to respective pipes located on the outside of the separator.

6. A subsea system according to claim 1, further comprising at least one gas outlet located in the upper part of the separator proximate the well flow inlet and a gas injection pipe located proximate the oil/gas outlet arrangement.

7. A subsea system according to claim 6, further comprising a gas splitter located downstream of the gas outlet, which gas splitter divides into the gas injection pipe and a gas production pipe that leads to a processing facility.

8. A subsea system according to one of claims 1-7, further comprising at least one pump located downstream of each fluid outlet.

9. An oil/gas outlet arrangement for splitting oil and gas, the oil/gas outlet arrangement comprising at least one crown device having an inverted conical configuration and an axis which is oriented generally vertically, the crown device including an outer wall and at least one cutout formed in said outer wall through which the oil and gas can flow into the crown device, a bottom end of said crown device being in fluid connection with at least two fluid outlets in the oil/gas outlet arrangement.

* * * * *